US006742627B2

(12) United States Patent
Drabot et al.

(10) Patent No.: US 6,742,627 B2
(45) Date of Patent: Jun. 1, 2004

(54) ELEVATOR PRESSURE TRACTION ARRANGEMENT

(75) Inventors: Slawomir Drabot, Farmington, CT (US); Michael Flynn, Avon, CT (US); Simon Shang, Folsom, CA (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/916,743

(22) Filed: Jul. 27, 2001

(65) Prior Publication Data

US 2003/0051948 A1 Mar. 20, 2003

(51) Int. Cl.[7] ..... B66B 11/08
(52) U.S. Cl. ..... 187/254; 187/251; 254/333
(58) Field of Search ..... 187/250, 251, 187/254, 266; 254/333, 265

(56) References Cited

U.S. PATENT DOCUMENTS

| | | | | | |
|---|---|---|---|---|---|
| 258,073 | A | * | 5/1882 | Johnston | 187/263 |
| 3,847,378 | A | * | 11/1974 | Roemer, Jr. | 254/265 |
| 4,620,615 | A | * | 11/1986 | Morris et al. | 187/264 |
| 5,782,333 | A | | 7/1998 | Pitts | |
| 5,921,352 | A | | 7/1999 | Garrido et al. | |
| 6,105,727 | A | * | 8/2000 | Nakao | 187/251 |
| 6,193,016 | B1 | * | 2/2001 | Hollowell et al. | 187/250 |

FOREIGN PATENT DOCUMENTS

| | | | | | |
|---|---|---|---|---|---|
| CA | 518489 | | * | 11/1995 | 254/265 |
| EP | 565516 | A1 | * | 10/1993 | 187/251 |
| FR | 2640604 | A1 | * | 6/1990 | 187/266 |
| GB | 864960 | A | * | 4/1961 | 187/239 |

* cited by examiner

*Primary Examiner*—Eileen D. Lillis
*Assistant Examiner*—Thuy V. Tran
(74) *Attorney, Agent, or Firm*—Carlson, Gaskey & Olds

(57) ABSTRACT

A traction arrangement for propelling an elevator cab within an elevator system includes a traction device. The traction device applies a load normal to a driving sheave that biases the elevator rope or belt against the sheave. The tension device preferably includes a plurality of rolling members that move about their axes responsive to relative movement between the driving sheave and the rope or belt. A traction belt rides upon the rolling members and the traction belt engages the rope or belt to bias it against the driving sheave with a preferably distributed force.

16 Claims, 1 Drawing Sheet

ELEVATOR PRESSURE TRACTION ARRANGEMENT

BACKGROUND OF THE INVENTION

This invention generally relates to a system for propelling an elevator. More particularly, this invention relates to a system for providing traction between a sheave and a belt or rope.

Elevator systems typically include a mechanism for moving the elevator cab as desired within a hoistway, for example. Some systems include a counterweight and sheave arrangement that moves a counterweight and cab through the hoistway between landings as needed. Other systems, commonly referred to as "self-propelled" systems include a driving mechanism that is supported for movement with the elevator cab through the hoistway.

The load of the counterweight and the cab in counterweighted systems provides the necessary traction between the rope or belt and the driving sheaves to achieve proper elevator operation. In order to achieve a desired amount of traction, the mass of the cab and counterweight typically is quite large. Larger loads introduce additional wear on the belts or ropes.

There are several possible disadvantages associated with the traditional approach when additional traction is required. One is that adding additional mass introduces additional material and labor cost during assembly, for example. Additionally, multiple belts or ropes are required and the corresponding sheaves must have multiple grooves to accommodate the multiple ropes. This adds complexity and material cost to the system. Another drawback associated with such systems is that the belts or ropes typically are maintained under constant tension, which introduces the possibility for additional wear on the belts, requiring more frequent maintenance or replacement.

There is a need for an improved system to provide appropriate traction in an elevator system for moving the cab as desired. This invention addresses that need while avoiding the shortcomings and drawbacks of the prior attempts discussed above.

SUMMARY OF THE INVENTION

In general terms, this invention is an assembly for propelling an elevator cab. The assembly includes at least one tension device that biases an elevator rope or belt against a driving sheave. The tension device includes a plurality of rolling members that are supported in a selected position relative to the driving sheave. The rolling members preferably are passive and roll responsive to relative movement between the driving sheave and the elevator rope or belt. A tension belt is associated with the rolling members. The tension belt engages the elevator rope or belt and applies a force that biases the rope or belt against the driving sheave.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
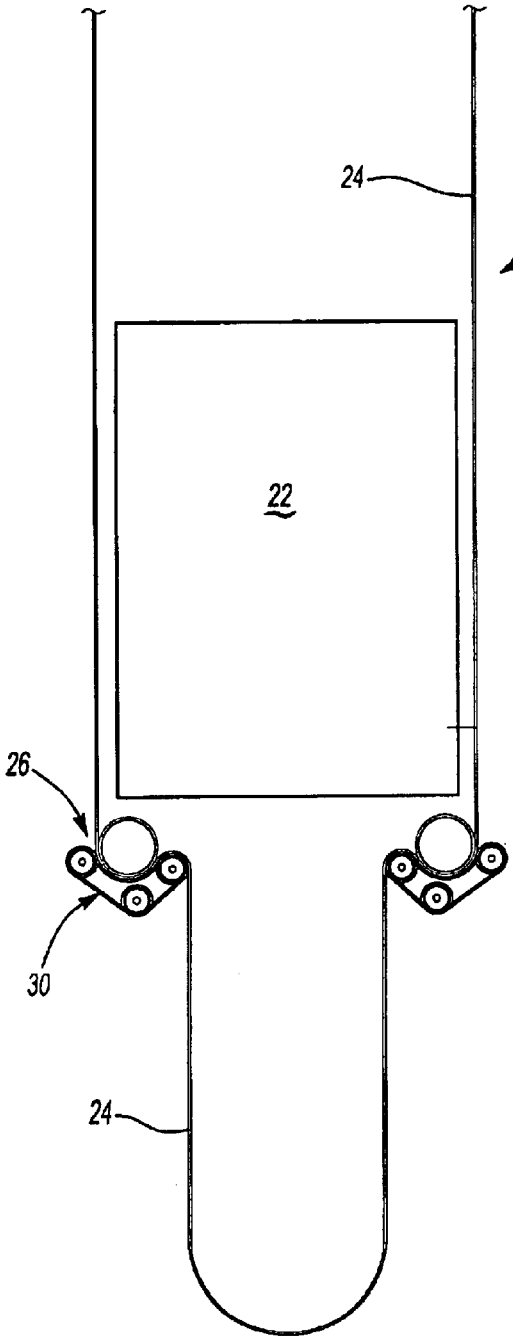
FIG. 1 schematically illustrates an elevator system designed according to this invention.

An elevator system 20 includes an elevator cab 22 that is adapted to carry a load, such as passengers or cargo between various landings within a building, for example. An elevator load bearing member 24 preferably has two ends secured at an upper location (not illustrated) within a hoistway.

The illustrated example system 20 is a self-propelled elevator system. That is, it is the type of elevator system that does not have a driving mechanism arranged in a fixed location within a machine room, for example, and it does not rely upon a counterweight to achieve desired elevator cab movement and positioning. This invention, however, is not strictly limited to self-propelled elevator systems. Examples of this invention are particularly useful for self-propelled systems and, therefore, one is schematically illustrated for discussion purposes in FIG. 1.

At least one driving sheave 26 includes a rotating portion 28 that rotates to achieve movement of the cab 22 as desired. A driving mechanism 29, such as a motor, provides a force to rotate the rotating portion 28 as needed. Driving sheave arrangements are well known in the art. At least one traction device 30 is associated with the driving sheave 26. The traction device 30 applies a normal force along a portion of the load bearing member 24 toward the center of the sheave 26 biases the load bearing member 24 against the driving sheave rotating portion 28. The load bearing member 24 may be a rope or belt depending on the needs of a particular situation.

Figure 2:
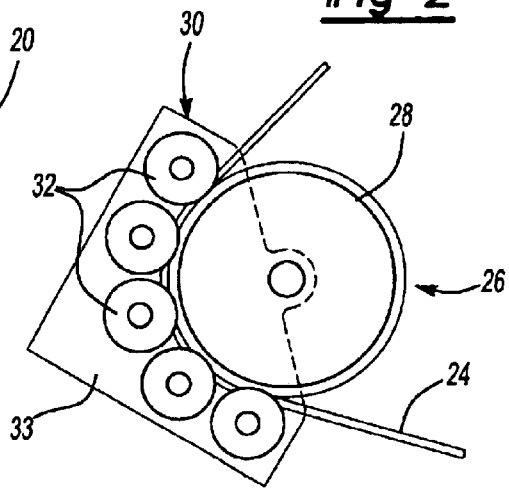
FIG. 2 schematically illustrates one example tension device designed according to this invention.

In the example of FIG. 2, a plurality of rolling members 32 are supported by a bracket that is mounted on the sheave assembly 26 so that their axes remain relatively stationary relative to the driving sheave rotating portion 28. The load bearing member 24 is received between the rolling members 32 and the rotating portion 28. The rolling members 32 preferably are supported relative to the driving sheave 26 so that they continuously apply a normal force (relative to a tangent at a corresponding point of contact between the member 24 and the rotating portion 28) to bias a corresponding portion of the load bearing member 24 against the rotating portion 28. Some resiliency in positioning the rollers 32 relative to the sheave 26 is preferred to more evenly distribute the normal forces applied to the load bearing member. In one example, springs (not illustrated) bias the rollers into position to apply the normal force. In the example of FIG. 2, the rolling members 32 are passive and roll responsive to relative movement between the load bearing member 24 and the rotating portion 28. The rolling members preferably extend around a portion of a circumference of the rotating portion 28.

The bias provided by the traction device 30 preferably provides a uniformly distributed, static force on the load bearing member 24. Any portion of the circumference of the driving sheave may be accommodated with the traction device 30. When the traction device 30 extends across a larger arc, better traction is achieved.

Figure 3:
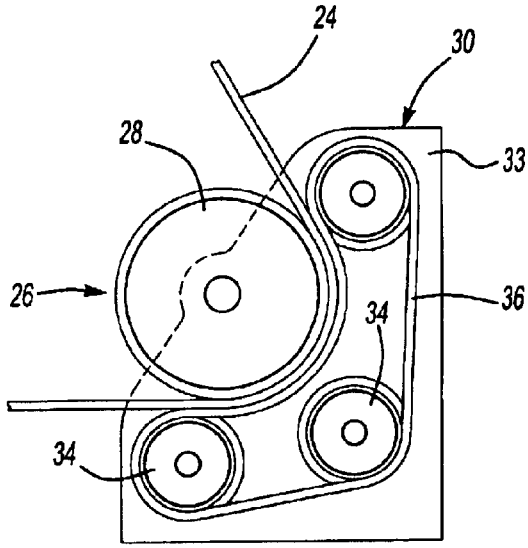
FIG. 3 illustrates another example tension device designed according to this invention.

FIG. 3 illustrates another example traction device 30 designed according to this invention. In this example, rolling members 34 are supported on a bracket 33 so that their axes remain relatively stationary relative to the rotating portion 28. As in the previous example, some resiliency is preferred so that the position of each roller 34 is not completely fixed. A traction belt 36 is received around the rolling members 34. The traction belt 36 engages the elevator load bearing member 24 and applies a normal force that biases the load bearing member against the rotating portion 28. The rolling members 34 and the traction belt 36 move responsive to relative movement between the rotating portion 28 and the load bearing member 24. The traction belt 36 preferably engages a portion of the load bearing member 24 around an arcuate length of the perimeter of the rotating portion 28.

A traction device designed according to this invention provides significant advantages compared to the traditional mass-based arrangements previously used to provide traction within self-propelled elevator systems. The inventive arrangement eliminates the components and size constraints imposed by the use of the large masses. Installation labor time is also reduced, which presents a cost savings.

It is possible with this invention to eliminate any use of a counterweight or other mass for maintaining tension on a belt or rope in an elevator system. This invention provides the capability of utilizing a system as schematically illustrated in FIG. 1 where the load bearing member 24 effectively has tension on one side of the driving sheave 26 because of the mass of the cab portion 22 with relatively little tension on an opposite side of the sheave 26 because there is no mass tied to the load bearing member 24 on the opposite side. Of course, there is always some tension due to the mass of the load bearing member itself. This invention not only provides an arrangement for enhancing traction in mass-based systems so that the size of the required mass can be reduced or otherwise tailored to be more economical or efficient, but also presents the possibility for eliminating the use of a counterweight or other mass for creating tension to generate traction.

Accordingly, this invention provides the ability to eliminate a tension differential across a driven sheave for purposes of achieving traction. With this invention, a tension differential may be reduced as low as desired. Because of the preferably uniform distribution of a normal force that biases the load bearing member 24 against the driving sheave rotating portion 28, the tension ratio may be as low as zero.

This invention also allows more design freedom because the required angle of wrap of the load bearing member around the sheave can be modified (i.e., reduced) compared to the requirements necessary to achieve proper traction in purely mass-based systems. Additionally, there is more freedom in selecting materials and surface designs to provide a sufficient coefficient of friction associated with the sheave and the load bearing member. This allows for more economical and potentially more efficient system design.

Figure 4:
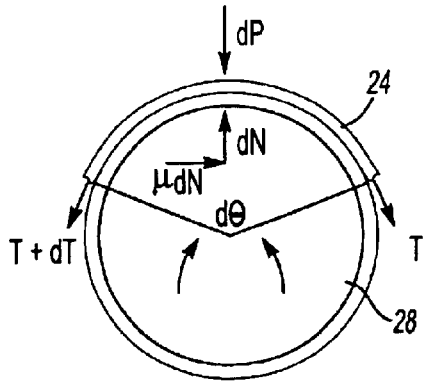
FIG. 4 schematically illustrates forces associated with one example embodiment of this invention.

The ability to eliminate the tension differential can be demonstrated as follows. Making reference to FIG. 4, and summing the normal and tangential forces that are at the contact surface between the load bearing member 24 and the rotating portion 28 of the sheave 26 provides the following equation:

$$dT-\mu Td\theta=P(\theta)d\theta;$$

where, $\mu dP$ is $=P(\theta)d\theta$;

dP=the applied normal load on the load bearing member 24 provided by the traction device 30;

$\mu$=the coefficient of friction; and

T=tension on the load bearing member 24.

Using standard integration techniques results in the following equation:

$$d\left(Te^{-\int_{\theta 1}^{\theta}\mu d\theta}\right)=Pe^{-\int_{\theta 1}^{\theta}\mu d\theta}.$$

Integrating this over an arcuate distance between $\theta_1$ and $\theta$ provides:

$$Te^{-\int_{\theta 1}^{\theta}\mu d\theta}+c=\int_{\theta 1}^{\theta}pe^{-\int_{\theta 1}^{\theta}\mu d\theta}d\theta.$$

Considering the instance where $\theta=\theta_1$, the previous equation is reduced to: $T_1+C=0$ and, therefore, $C=-T_1$. It follows that:

$$T=e^{\int_{\theta 1}^{\theta}\mu d\theta}\left[\int_{\theta 1}^{\theta}pe^{-\int_{\theta 1}^{\theta}\mu d\theta}d\theta+T_1\right].$$

Additionally, a system designed according to this invention allows a single load bearing member 24, such as a rope or belt, to replace two ropes or belts from earlier self-propelled systems. With this invention, a single rope or belt is associated with individual driving sheaves. A single groove is sufficient on a driving sheave to accommodate an arrangement designed according to this invention. This introduces material cost savings and serves to simplify component design. Moreover, the tension and load on the elevator load bearing member 24 is reduced by using traction devices designed according to this invention.

The preceding description is exemplary rather than limiting in nature. Variations and modifications to the disclosed examples may become apparent to those skilled in the art that do not depart from the essence of this invention. The scope of legal protection given to this invention can only be determined by studying the following claims.

We claim:

1. An assembly for propelling an elevator cab, comprising:

at least one sheave having a rotating portion;

an elongated load bearing member that engages the rotating portion such that movement of the rotating portion propels the elevator cab; and at least one traction device supported near the rotating portion, the traction device continuously biasing the load bearing member against the rotating portion along an arcuate portion of the rotating portion, the traction device including a plurality of rolling members and a traction belt that is supported on the rolling members, the traction belt engaging the load bearing member, the traction belt moving relative to the rolling members responsive to movement of the rotating portion.

2. The assembly of claim 1, wherein the load bearing member comprises a belt.

3. The assembly of claim 1, wherein the load bearing member comprises a rope.

4. The assembly of claim 1, wherein the sheave is supported for movement with the elevator cab and the traction device moves with the cab.

5. The assembly of claim 1, wherein the traction belt applies a uniformly distributed load onto the load bearing member in a direction normal to the surface of the sheave rotating portion along a portion of the load bearing member engaged by the traction belt.

6. An elevator system comprising:

a cab adapted to carry a load between landings;

an elongated load bearing member that supports the cab and an associated load;

at least one driving sheave that is supported for movement with the elevator cab and that has a rotating portion that engages the load bearing member such that movement of the rotating portion moves the elevator cab relative to the load bearing member; and at least one traction device supported near the driving sheave, the traction device continuously biasing a corresponding portion of the load bearing member against the rotating portion, the traction device including a plurality of rolling members and a traction belt that is supported on the rolling members, the traction belt engaging the load bearing member.

7. The system of claim 6, wherein the traction belt moves relative to the rolling members responsive to relative movement between the load bearing member and the rotating portion.

8. The system of claim 6, wherein the load bearing member comprises a belt.

9. The system of claim 6, wherein the load bearing member comprises a rope.

10. The assembly of claim 6, wherein the traction belt applies a uniformly distributed load onto the load bearing member along a portion of the load bearing member engaged by the traction belt.

11. An elevator system comprising:

a cab adapted to carry a load between landings;

an elongated load bearing member that supports the cab and an associated load;

at least one driving sheave supported for movement with the elevator cab that has a rotating portion that engages the load bearing member such that movement of the rotating portion moves the elevator cab relative to the load bearing member; and at least one traction device supported near the driving sheave, the traction device contacting and continuously biasing a corresponding portion of the load bearing member against the rotating portion, the traction device providing sufficient traction between the load bearing member and the rotating portion to allow the movement of the rotating portion to move the elevator cab.

12. The system of claim 11, wherein the traction device includes a plurality of rolling members and a traction belt that is supported on the rolling members, the traction belt engaging the load bearing member.

13. The system of claim 12, wherein the traction belt moves relative to the rolling members responsive to relative movement between the load bearing member and the rotating portion.

14. The assembly of claim 12, wherein the traction belt applies a uniformly distributed load onto the load bearing member along a portion of the load bearing member engaged by the traction belt.

15. The system of claim 11, wherein the load bearing member comprises a rope.

16. The system of claim 11, wherein the load bearing member comprises a belt.

* * * * *